US005408805A

United States Patent [19]

Graffin

[11] Patent Number: 5,408,805

[45] Date of Patent: Apr. 25, 1995

[54] METHOD OF PLACING A LENGTH OF HEAT-SEALABLE STRIP OVER RECEPTACLES, AND APPARATUS IMPLEMENTING THE METHOD

[75] Inventor: André Graffin, La Chapelle du Bois, France

[73] Assignee: Serac France, La Ferte Bernard, France

[21] Appl. No.: 90,280

[22] Filed: Jul. 13, 1993

[30] Foreign Application Priority Data

Jul. 17, 1992 [FR] France ..... 92 08854

[51] Int. Cl.[6] ..... B65B 7/28; B67B 5/00

[52] U.S. Cl. ..... 53/487; 53/298; 53/314; 53/329.3; 53/329.5

[58] Field of Search ..... 53/298, 329.3, 329.2, 53/471, 478, 314

[56] References Cited

U.S. PATENT DOCUMENTS

| | | | |
|---|---|---|---|
| 985,803 | 3/1911 | Hodgkinson | 53/298 X |
| 2,097,383 | 10/1937 | Riemer | 53/298 X |
| 3,527,020 | 9/1970 | Mancini | 53/329.3 |
| 3,834,120 | 9/1974 | De Faccio et al. | 53/298 |
| 4,092,817 | 6/1978 | Rist, III | 53/298 |
| 4,282,698 | 8/1981 | Zimmermann | 53/298 X |
| 4,575,987 | 3/1986 | Fortuna . | |

*Primary Examiner*—Horace M. Culver
*Attorney, Agent, or Firm*—Griffin, Butler Whisenhunt & Kurtossy

[57] ABSTRACT

The method applies to a receptacle-closing carousel that includes a rotary platform fitted with receptacle holding members and associated with a receptacle insertion member and with a receptacle extraction member. The method consists in cantilevering out a length of heat-sealable strip in the receptacle insertion direction over a sector of the platform that extends between the receptacle extraction member and the receptacle insertion member, relative to the direction of rotation of the platform.

4 Claims, 3 Drawing Sheets

METHOD OF PLACING A LENGTH OF HEAT-SEALABLE STRIP OVER RECEPTACLES, AND APPARATUS IMPLEMENTING THE METHOD

The present invention relates to a method of placing a length of heat-sealable strip over receptacles in a carousel for closing receptacles, and it also relates to apparatus for implementing the method.

BACKGROUND OF THE INVENTION

Installations are known for closing receptacles heat-sealing a length of strip, generally a length of composite strip including a layer of material suitable for welding to the orifice of a receptacle and a layer that forms a barrier against ultraviolet radiation or that provides mechanical strength to the length of strip installed on the orifice of the receptacle.

In such installations, the length of heat-sealable strip is cantilevered out over the orifice of a receptacle, and then a heat-sealing head is lowered to weld the length of strip. A special problem arises when the heat-sealable strip is of insufficient stiffness to enable the length of heat-sealable strip to extend horizontally over the orifice of the receptacle. Under such circumstances, the length of strip tends to droop downwards as soon as it is cantilevered out, and mere friction against the top orifice of the receptacle causes the length of strip to wrinkle so that it does not completely cover the orifice of the receptacle at the moment when the heat-sealing heat is engaged, and as a result the receptacle is not properly closed. To ensure that the orifice of the receptacle is properly covered when using a very fine heat-sealable strip of low stiffness, proposals have therefore been made to install grasping devices that grasp one end of the strip and pull it over the location of a receptacle.

Such devices are complex and use up a considerable amount of strip because of the portion of strip that must be provided to give a grasp to the grasping means.

OBJECT AND SUMMARY OF THE INVENTION

The present invention provides a method of installing a length of heat-sealable strip over receptacles in a carousel for closing the receptacles, and including a rotary platform fitted with receptacle holding members disposed beneath heat-sealing heads, the platform being associated with a receptacle insertion member and with a receptacle extraction member, the method consisting in cantilevering out a length of heat-sealable strip in a receptacle insertion direction within a sector of the platform that extends in the direction of rotation of the platform between the receptacle extraction member and the receptacle insertion member.

Thus, when a receptacle is inserted on the platform after the length of strip has been advanced, the receptacle engages beneath the length of strip and tends to straighten it out in one direction without any danger of causing the length of strip to wrinkle, such that the length of strip lies flat over the top orifice of the receptacle when the receptacle is in place on the platform.

According to another aspect of the invention, apparatuses is provided for implementing the method and comprising a heat-sealable strip advance member disposed to push the heat-sealable strip in a receptacle insertion direction and provided with a strip sectioning member, the strip advance member being mounted to pivot about an axis that is substantially horizontal and including a lifting member. Thus, at the moment a receptacle is inserted, the strip advance member is slightly raised to allow the receptacle to pass without interfering with the strip sectioning member.

BRIEF DESCRIPTION OF THE DRAWINGS

Other characteristics and advantages of the invention appear on reading the following description of a particular non-limiting embodiment of the invention described with reference to the accompanying figures, in which.

MORE DETAILED DESCRIPTION

Figure 1:
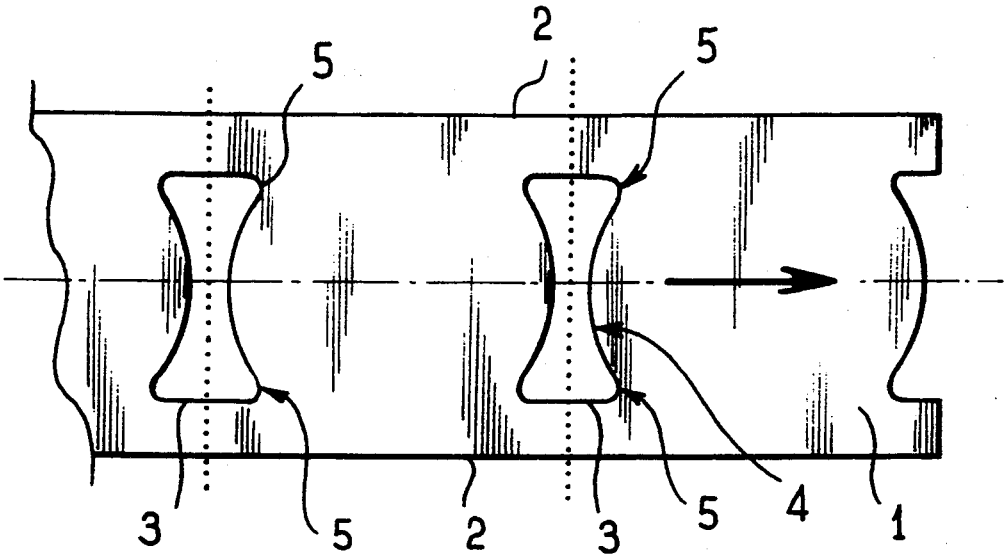
FIG. 1 plan view of a heat-sealable strip used in the method of the invention.

With reference to FIG. 1, the heat-sealable strip shown and given overall reference 1 comprises two substantially rectilinear parallel edges 2 between which cutouts 3 are formed in the middle portion of the strip.

With reference to the displacement direction of the strip, each cutout includes a leading edge having a central curvilinear portion 4 that is convex, and two end curvilinear portions 5 that are concave.

Figure 3:
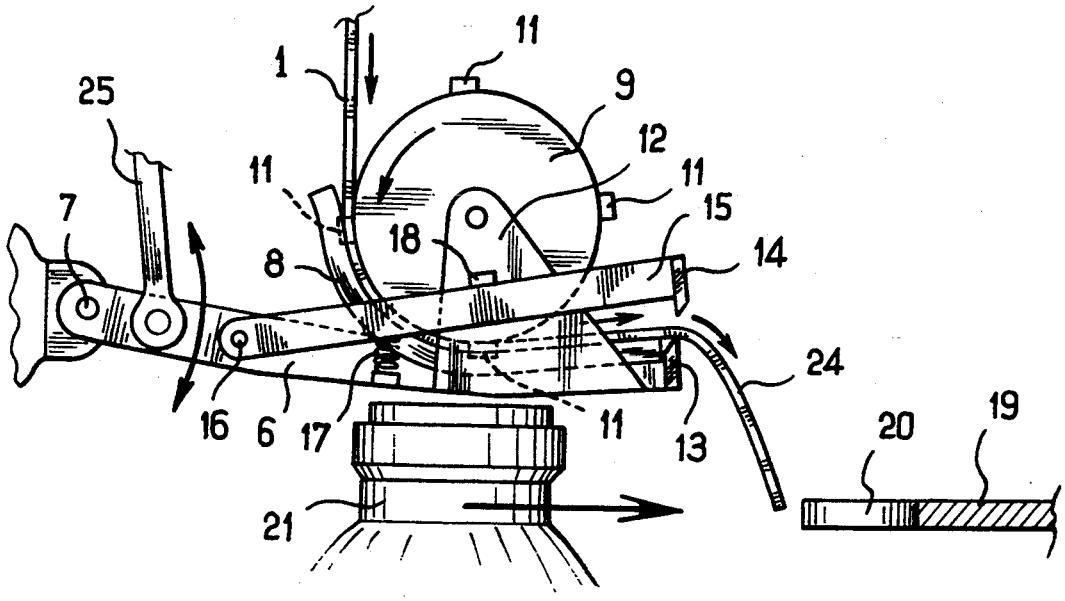
FIG. 3 is a diagrammatic elevation view of a strip advance device at the moment when a receptacle is inserted.
Figure 4:
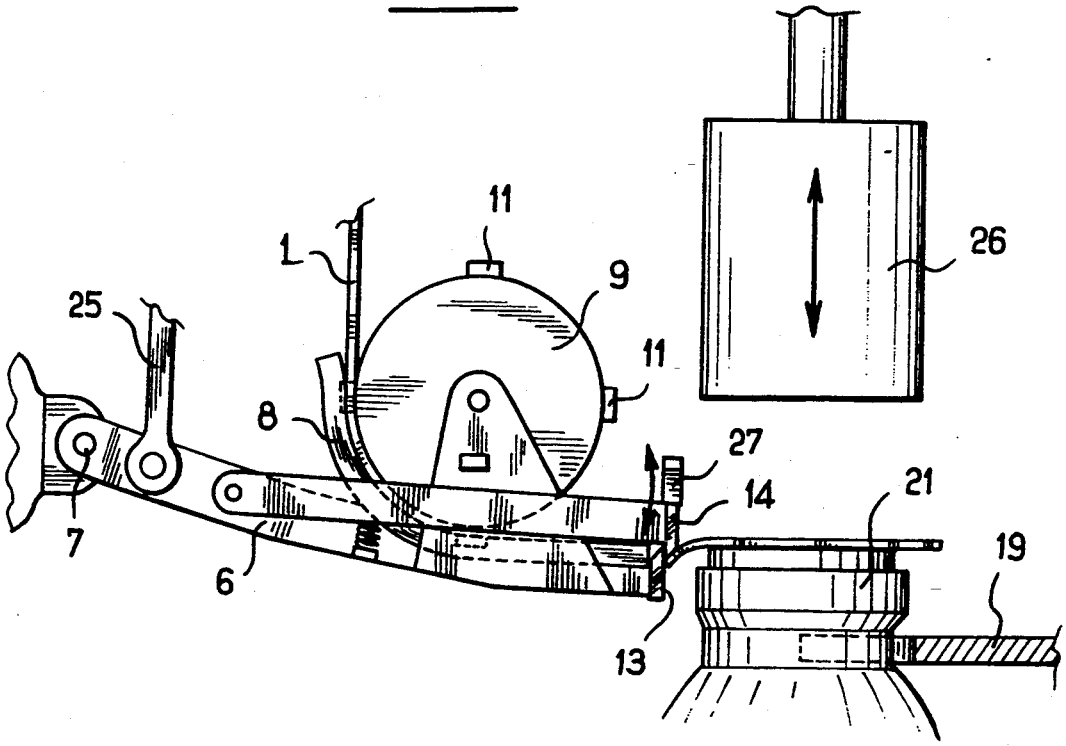
FIG. 4 a view of the FIG. 3 strip advance device at the moment when a length of strip is sectioned.
Figure 5:
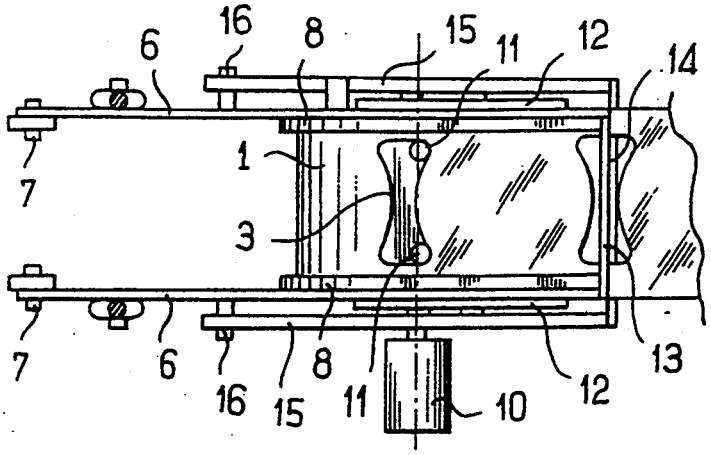
FIG. 5 is a plan view of the strip advance device of FIG. 4.

With reference to FIGS. 3 to 5, the strip advance device includes two support arms 6 connected to hinges 7 enabling them to pivot about an axis that is substantially horizontal. Guide members 8 are fixed to the support arms 6 and extend beneath the side edges of the strip. A stepper drive member represented by a roller 9 driven by a stepper motor 10 is disposed facing the guide members 8 and includes cylindrical drive studs 11 projecting between the guide members and disposed to engage in the cutouts 3 of the heat-sealable strip.

In the illustrated preferred embodiment, the studs 11 have a radius that is equal to the radius of curvature of the edge portions 5 of the cutouts 3, and their right cross-section is smaller than the portions of the cutouts in which they engage. The roller 9 is supported by gusset plates 12 fixed to the sides of the support arms 6. At its front end, the strip advance device includes shears comprising a lower blade 13 fixed to the end of the support arms 6 and a upper blade 14 carried by arms 15 hinged about axes 16 carried by the support arms 6. The shears are urged towards an open position by a spring 17, with the stroke of the arms 15 being limited by abutments 18 carried by the gusset plates 12.

Figure 2:
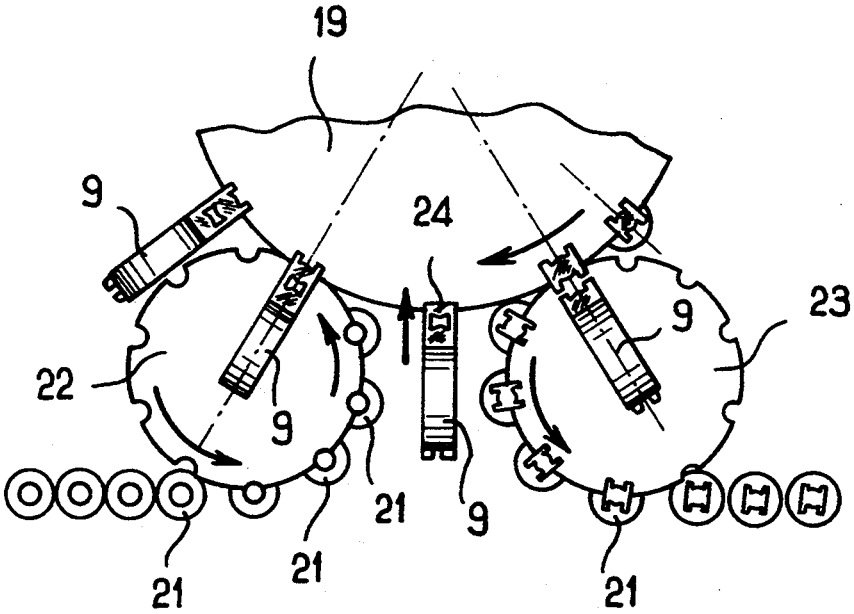
FIG. 2 is a fragmentary diagrammatic plan view of a carousel illustrating the method of the invention.

The strip advance device is disposed at each station of a receptacle closure carousel as shown in FIG. 2 and comprising a rotary platform 19 fitted with peripheral notches 20 forming members for holding receptacles 21 that are inserted on the carousel by a receptacle insertion member 22 and that are extracted therefrom by a receptacle extraction member 23. The strip advance devices are secured to the platform 19 and therefore rotate together with said platform while remaining permanently level with respective notches 20.

Figure 6:
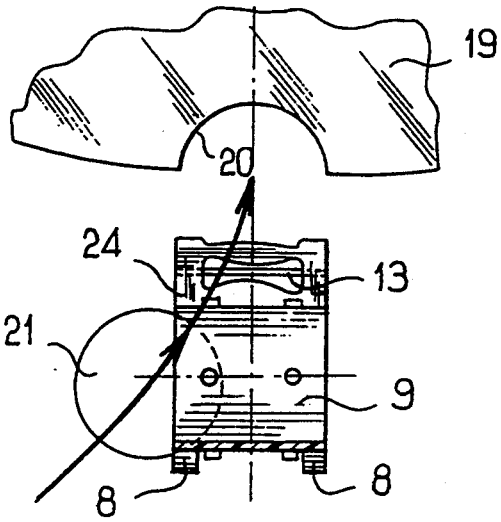
FIGS. 6 to 9 are fragmentary diagrammatic plan views of the strip advance device facing the platform of a carousel at various different instants while a receptacle is being inserted on the carousel.
Figure 7:
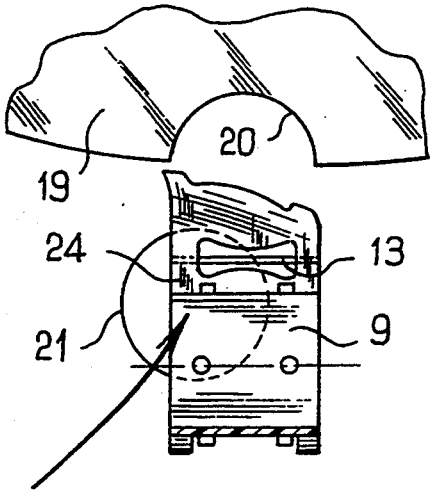
Figure 8:
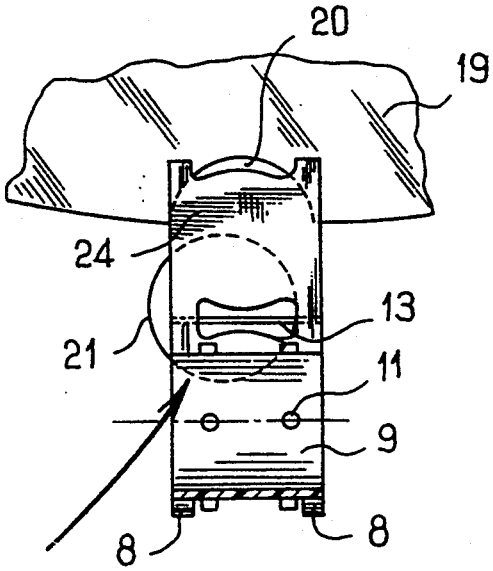
Figure 9:
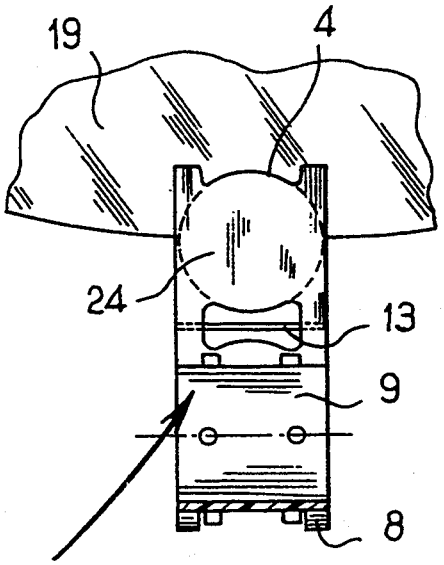

In the embodiment shown, the receptacle insertion member 22 and the receptacle extraction member 23 are each constituted by respective disks that are tangential to the platform 19 such that given the relative motion of the platform 19 and the receptacle insertion member 22, receptacles 21 are inserted on the platform 19 via a curve that is tangential to the radius of the platform 19 as represented in FIG. 6 by a chain-dotted line, together with a bold-line arrow associated therewith.

According to the invention, the strip advance devices are disposed so that the length of strip 24 that is cantilevered out by a strip advance device is also directed radially relative to the platform 19. In the method of the invention, the length of strip 24 is cantilevered out while the strip advance device is in the sector that lies between the receptacle extraction member 23 and the receptacle insertion member 22 (relative to the direction of rotation of the platform). The length of strip can be cantilevered out freely in this position since there is no receptacle disposed beneath the length of strip. This method of installing the strip 24 is particularly useful when the strip is very thin and of insufficient rigidity to be cantilevered out horizontally since it tends to droop down beyond the end of the strip advance device, as shown in FIG. 3. When a receptacle is inserted on the platform following the motion shown by FIG. 6, the receptacle therefore engages beneath the cantilevered out length of strip in a direction going from the strip advance device towards the free end of the length of strip such that the receptacle tends progressively to raise the length of strip 24 as shown in FIGS. 6 to 9 where the receptacle is represented by a circle symbolizing the top edge of its orifice. At the moment when the receptacle is fully engaged in a holding notch 20, the length of strip 24 thus rests on the top edge of the orifice of the receptacle.

To prevent the receptacle 21 coming into abutment against the lower blade 13 of the shears while the receptacle is being inserted, the strip advance device is preferably raised at the moment of insertion, as shown in FIG. 3, said raising being performed, for example, by means of a rod 25 associated with a control device (not shown) which is preferably synchronized with the movements of the heat-sealing head 26.

When the receptacle is fully engaged in a holding notch 20 with the length of strip 24 resting on the top edge of the orifice of the receptacle 21, then the strip advance device is lowered as shown in FIG. 4 so that the top edge of the lower blade 13 lies exactly in the same plane as the top edge of the receptacle 21, so that the length of strip then rests against the entire perimeter of the orifice of the receptacle- The heat-sealing head 26 is then lowered to weld the length of strip 24 onto the receptacle orifice, and then the upper blade 14 of the shears is lowered to cut off the length of strip.

As shown in FIG. 4, lowering of the upper blade 14 is preferably caused by a cam 27 fixed to the frame of the carousel such that the shears associated with a strip advance device are actuated each time they move past the cam 27.

Naturally, the invention is not limited to the embodiment described and variant embodiments may be provided without going beyond the ambit of the invention as defined by the claims.

In particular, although the invention is described above with reference to a heat-sealable strip that includes cutouts in the central portion of the strip and a strip advance device that includes positive drive members for engaging the strip, the method of the invention is equally applicable to a heat-sealable strip that includes no cutouts or that includes lateral cutouts, in association with any kind of strip advance device, e.g. a device comprising smooth drive rollers that act on the heat-sealable strip by pinching it.

I claim:

1. In a method of positioning a length of heat-sealable strip over receptacles disposed in a carousel for closing the receptacles, said carousel including a rotatable platform having at least one receptacle holding member disposed beneath heat-sealing heads, a receptacle insertion member for inserting receptacles into the holding members in a receptacle insertion direction and a receptacle extraction member for extracting receptacles from the holding members, the improvement comprising the steps of cantilevering out a length of heat-sealable strip in the receptacle insertion direction within a sector of the platform that extends between the receptacle extraction member and the receptacle insertion member with reference to a direction of rotation of the platform, and thereafter inserting a receptacle in the receptacle insertion direction into the holding member such that the insertion of the receptacle tends to progressively raise the cantilevered out length of heat-sealable strip.

2. A carousel for closing receptacles comprising a rotatable platform having at least one receptacle holding member disposed at the periphery of said rotatable platform and beneath a heat-sealing head, a receptacle insertion member for inserting receptacles into the holding member in a receptacle insertion direction, a receptacle extraction member for extracting receptacles from the holding member, and a strip advance device disposed radially outwardly from the platform and facing said receptacle holding member, said strip advance device including a guide member for guiding the strip in said receptacle insertion direction.

3. A carousel according to claim 2 further including a strip sectioning member positioned radially inwardly with respect to said guide member.

4. A carousel according to claim 2 wherein said strip advance member is mounted to pivot about a horizontal axis disposed radially outwardly with respect to said strip advance member.

* * * * *